US007415853B2

(12) United States Patent
Yu

(10) Patent No.: US 7,415,853 B2
(45) Date of Patent: Aug. 26, 2008

(54) DUAL LOCKING DEVICE

(76) Inventor: Chun Te Yu, No.253, Sec. 3, Yanhai Rd., Fusing Township, Changhua County 506 (TW)

( * ) Notice: Subject to any disclaimer, the term of this patent is extended or adjusted under 35 U.S.C. 154(b) by 17 days.

(21) Appl. No.: 11/401,233

(22) Filed: Apr. 11, 2006

(65) Prior Publication Data

US 2006/0254329 A1 Nov. 16, 2006

Related U.S. Application Data

(63) Continuation-in-part of application No. 11/126,199, filed on May 11, 2005, now Pat. No. 7,104,092.

(30) Foreign Application Priority Data

Apr. 11, 2005 (TW) ..... 94205599 U
Oct. 6, 2005 (TW) ..... 94135013 A

(51) Int. Cl.
*E05B 67/38* (2006.01)

(52) U.S. Cl. ..... 70/68; 70/21; 70/284; 70/285; 70/432

(58) Field of Classification Search ..... 70/2–13, 70/26, 30, 31, 49, DIG. 37, 68–75, 312, 21, 70/25, 432–441, 284, 285, DIG. 63, DIG. 71
See application file for complete search history.

(56) References Cited

U.S. PATENT DOCUMENTS 1,545,666 A * 7/1925 Kornhaber et al. ..... 70/26
3,439,515 A * 4/1969 Gehrie ..... 70/288
3,750,431 A * 8/1973 Atkinson ..... 70/21
3,837,189 A * 9/1974 Atkinson ..... 70/21
4,325,240 A * 4/1982 Gable ..... 70/284
4,751,830 A * 6/1988 Cheng ..... 70/25
4,884,419 A * 12/1989 Ling ..... 70/4
5,868,012 A * 2/1999 Chun-Te et al. ..... 70/30
6,539,761 B2 * 4/2003 Yang ..... 70/284
6,708,534 B1 * 3/2004 Ruan ..... 70/38 A
6,843,080 B1 1/2005 Yu
6,848,283 B1 * 2/2005 Lin ..... 70/21
6,860,125 B1 * 3/2005 Yu ..... 70/25
6,877,345 B1 * 4/2005 Misner et al. ..... 70/25
6,880,370 B2 * 4/2005 Yu ..... 70/25
6,904,776 B1 * 6/2005 Lin ..... 70/25
6,912,880 B2 7/2005 Ling et al.
7,003,988 B2 * 2/2006 Yu ..... 70/25
7,007,520 B1 * 3/2006 Lin ..... 70/21
7,104,092 B2 * 9/2006 Yu ..... 70/21
2002/0088256 A1 * 7/2002 Taylor et al. ..... 70/25
2004/0226323 A1 * 11/2004 Ling et al. ..... 70/25
2004/0226324 A1 * 11/2004 Loughlin et al. ..... 70/25
2004/0255624 A1 * 12/2004 Loughlin et al. ..... 70/56
2005/0034492 A1 * 2/2005 Yu ..... 70/25

(Continued)

*Primary Examiner*—Lloyd A Gall
(74) *Attorney, Agent, or Firm*—Rosenberg, Klein & Lee

(57) ABSTRACT

A dual locking device is provided for securing a plugging member of a case, such as a luggage case or suitcase or the like, and comprises a housing, a switching mechanism, a restriction member and two locking devices. The switching mechanism includes a push-button and a securing member movable relative to the housing between a locked position and an unlocked position. Additionally, the restriction member is controlled by the locking devices respectively for retaining the switching mechanism, and is movable either through a first route between a retaining position and a first releasing position or through a second route between the retaining position and a second releasing position.

8 Claims, 17 Drawing Sheets

U.S. PATENT DOCUMENTS

2005/0039500 A1* 2/2005 Yu ..... 70/25
2005/0044901 A1* 3/2005 Yu ..... 70/25
2005/0092036 A1* 5/2005 Lai ..... 70/25
2005/0262902 A1* 12/2005 Ling et al. ..... 70/21

* cited by examiner

DUAL LOCKING DEVICE

CROSS REFERENCE TO RELATED APPLICATION

This is a continuation-in-part application of Ser. No. 11/126,199, filed on May 11, 2005, now U.S. Pat. No. 7,104,092.

TECHNICAL FIELD

This invention relates generally to a dual locking device for securing a plugging member, such as a zipper, of a luggage case. More particularly, to a dual locking device has an indicator.

BACKGROUND OF THE INVENTION

Various mechanical structures are employed to fabricate a lock device, especially in the design of a complicated dual locking device for security to against terrorists. One conventional technique, relative to the dual locking device, is disclosed in U.S. Pat. No. 6,843,080. The dual locking device of U.S. Pat. No. 6,843,080 has a shifting member controlled by a combination lock to block or open a bendable shackle element from a corresponding locking hole. Under the control of the combination lock, the shifting member itself is both linear displaceable and deflectedable about a horizontal shaft. When a correct code of the combination lock is set, a stopper of the shackle element can be brought to push the shifting member so that the shifting member is forced to deflect and displace to come off the corresponding locking hole so as to release the shackle element from the locking hole.

One limitation of U.S. Pat. No. 6,843,080 for the dual locking device is the difficulty or impossibility of applying the shifting member with two motions on a zipper lock for securing a latch hole of a zipper.

Another conventional lock is disclosed in U.S. Pat. No. 6,912,880 and is also relative to the dual locking device, which has a stopping member to block or open a way of a push-button to constrain or release a lock tongue of the dual locking device. More specifically, the stopping member is pivotally mounted in a lock body under controls of a key lock and a combination lock. Moreover, the key lock is far from the stopping member and is linked via a linking member. Upon this complicated design, the conventional lock of the U.S. Pat. No. 6,912,880 is big in size for its complicated structure with extra elements, such as the linking member and two push-buttons.

For microminiaturization of the lock, it would be advantage to provide a dual locking device, which is capable of meeting the increasingly insistent requests for reduction in cost, weight, section, and dimensions with the same reliability and usability.

From the foregoing descriptions, it will be seen that room exists for improvements in the base.

SUMMARY OF INVENTION

These needs have been partially resolved through the introduction of the present invention, whose characteristics include the reduction of dimension and weight, an easier assembly process, an increase in performance and a general reduction in production costs.

To overcome this, one aspect of the present invention proposes a miniature dual locking device to securing a plugging member, such as two pull tabs of a zipper fastener or two hook members on a luggage case. The design of the plugging member will make sure to be concise without losing the benefits of the prior art.

Accordingly, the present invention, briefly summarized, discloses a dual locking device comprising a housing, having at least one opening communicating with the interior of the housing for receiving a plugging member; a switching mechanism, having a push-button and a securing member movable relative to the housing between a locked position and an unlocked position by pushing the push-button which drives the securing member and is partly exposed on the outside of the housing; a restriction member capable of moving through a first route between a retaining position to a first releasing position and through a second route between the retaining position to a second releasing position; wherein the restriction member limits the movement of the switching mechanism while in the retaining position, and permits the switching mechanism to move to the unlocked position while in the first or second releasing positions; a first locking device provided for controlling the movement of the restriction member via the first route; and a second locking device provided for controlling the movement of the restriction member via the second route.

Additionally, the dual locking device of the present invention can further comprise an indicator, which normally displays a first state, but displays a second state when the dual locking device is unlocked by utilizing the first locking device. With the different states of the indicator, a lock owner who usually uses the second locking device can identify whether the dual locking device has been unlocked by anyone who uses the first locking device.

Another aspect of the present invention discloses a case comprising a case body, a case cover and the dual locking device as mentioned above, wherein a side of the case body is jointed with a side of the case cover, and the plugging member is mounted on the case cover for being secured in the dual locking device which is mounted on the case body.

BRIEF DESCRIPTION OF DRAWINGS

The invention will now be described solely by way of example and with reference to the accompanying drawings in which.

DETAILED DESCRIPTION OF PREFERRED EMBODIMENTS

Figure 2:
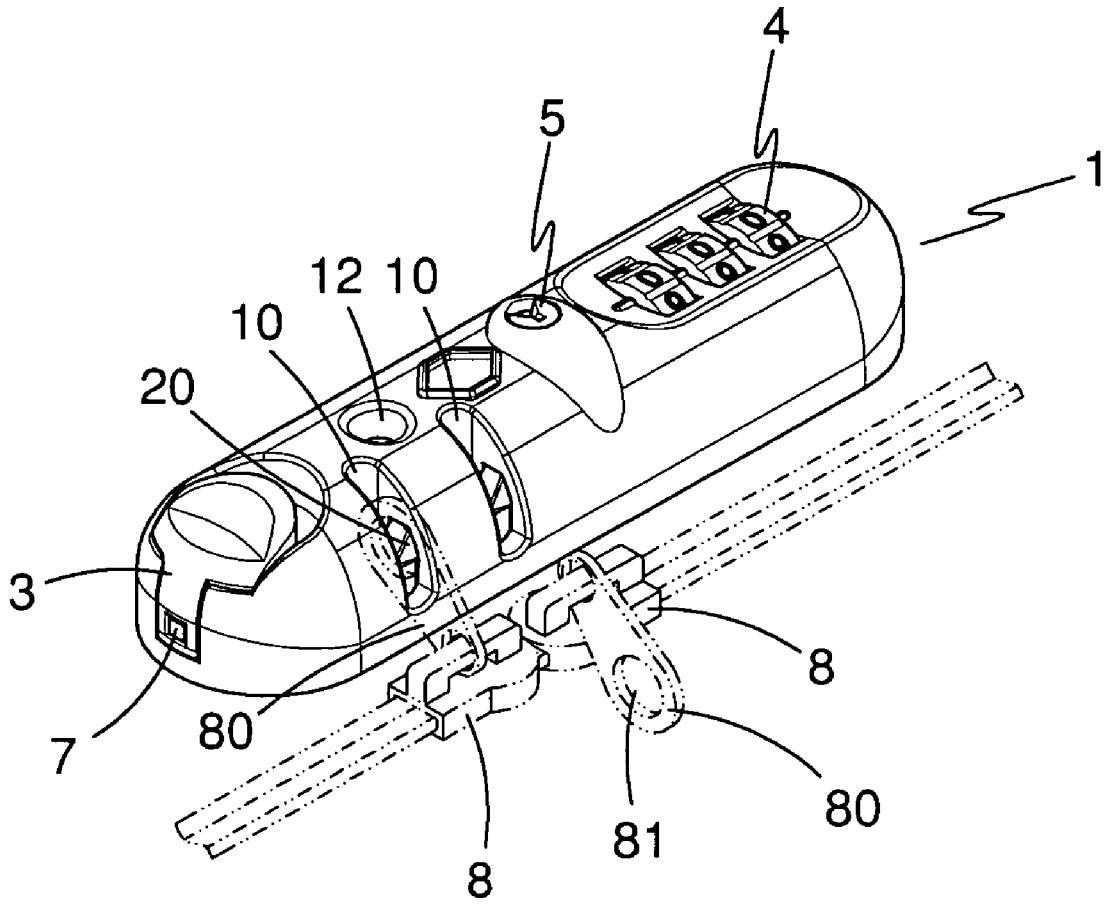
FIG. 2 is a perspective assembly view of FIG. 1.

The present invention is mainly provided with a dual locking device for securing a plugging member, such as a pull tab of a luggage case, as shown in FIG. 2.

With reference to FIGS. 1 to 14, descriptions will be made of a dual locking device according to a first embodiment of this invention.

Figure 1:
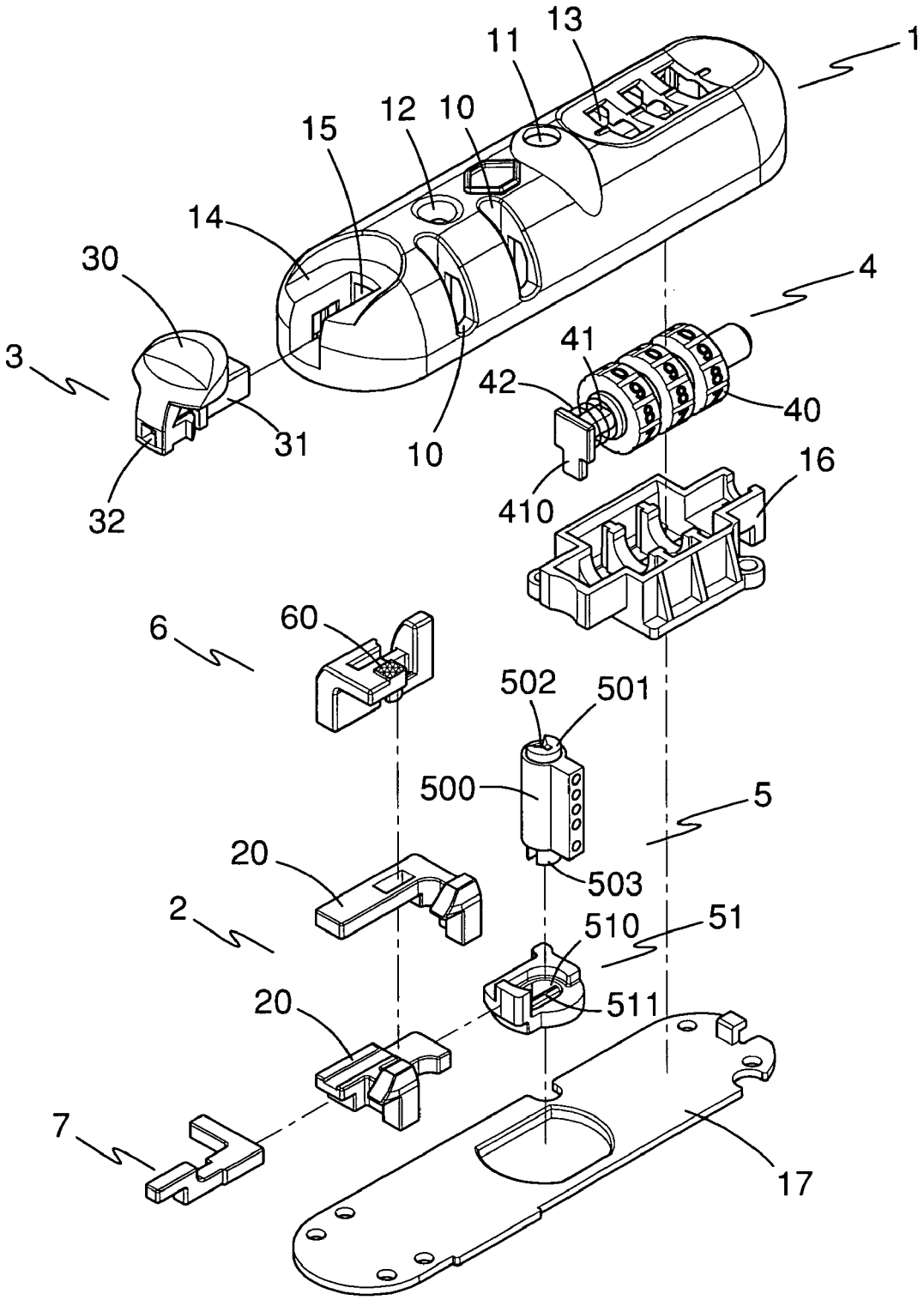
FIG. 1 is an exploded perspective view of a dual locking device in accordance with a first embodiment of the present invention.

Referring now to FIG. 1, the dual locking device in accordance with the first embodiment comprises a housing 1, a switching mechanism, a restriction member 51, a first locking device 5, and a second locking device 4. Additionally, the switching mechanism includes a push-button 3 and a securing member 2.

The housing 1 has a top formed with two openings 10 communicating with the interior of the housing 1 for receiving the plugging member 80 shown in FIG. 2. Furthermore, the housing 1 also has a through hole 11, a window 12 and a plurality of number wheel slots 13, and has a side formed with a broaden cavity 14 having a channel 15, which is in communication with the interior of the housing 1. Inside the housing 1, a body 16 is served as a carrier. A base 17 is disposed at a bottom of the housing 1 for covering the same.

The securing member 2 of the switching mechanism is disposed in the housing 1 and includes two retainers 20 overlapped with each other. The two retainers 20 move together to a locking position or an unlocking position while being driven so as to block or open the openings 10 of the housing 1 respectively.

The push-button 3 in relation with the securing member 2 has a pushing portion 30 movably mounted on the broaden cavity 14, a driving portion 31 received in the channel 15 of the housing 1 and against a side of the securing member 2, and a passage 32 passing through the pushing portion 30 and the driving portion 31. Thus, the two retainers 20 of the securing member 2 can be driven to come off the openings 10 by pushing the push-button 3 from the outside of the housing 1.

The first locking device 5 and the second locking device 4 are provided for controlling the movement of the restriction member 51. In the first embodiment, a key lock and a combination lock, as examples, are respectively the first locking device 5 and the second locking device 4. It is to be noted that, any combination from two locks of key locks and combination locks can serve as the first locking device and the second locking device.

The first locking device 5, namely the key lock, has a rotor 501, a sleeve 500 fixed on the housing 1 and receiving the rotor 501 which has an end formed with a key hole 502 exposed the outside of the through hole 11 of the housing 1 for being operated by a configured key (not shown) and has another end formed with a rider 503.

Figure 3:
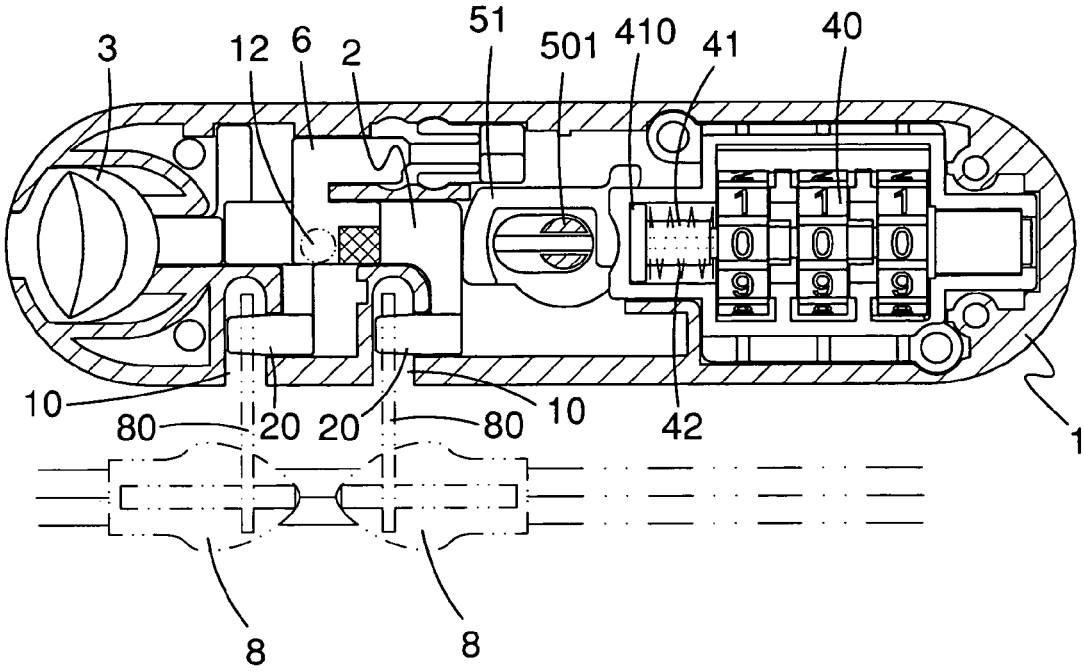
FIG. 3 shows that a restricting member is located between a combination lock and a push button according to the first embodiment.

The restricting member 51 installed in the housing 1 has a cave 510 for receiving the rider 503 of the rotor 501 and a rail 511 formed in the cave 510 so that the restricting member 51 can be rotated by rotating the rotor 501 via the configured key through a first route between a retaining position and a first releasing position. In the retaining position, the restricting member 51 is confined between the securing member 2 and an underneath of a block 410 of the combination lock 4, as shown in FIG. 3, and the securing member 2 thereby is blocked in the locking position. When the restricting member 51 is rotated to the first releasing position, the securing member 2 is allowed to move to the unlocked position. Instead of rotation, the restricting member 51 can move relative to the rider 503 of the rotor 501 to a second releasing position in a result of the sliding of the rail 511 ridden by the rider 503 of the rotor 501, as described later.

The second locking device 4, namely the combination lock, is fixed in the body 16 and has a number wheel unit 40 partly exposed the outside of the number wheel slots 13, a movable shaft 41 passing through the number wheel unit 40. The shaft 41 is movable axially when a set of correct codes of the combination lock 4 are dialed and is fixed when codes are incorrect. Furthermore, the movable shaft 41 has an end formed with the block 410 which is slidable along a specific range upon the body 16. The second locking device 4 further has a spring 42 which is around the movable shaft 41 and has one end against a side of the number wheel unit 40 and the other end against a back side of the block 410. Furthermore, a top portion of a front side of the block 410 is against a side of the body 16.

As shown in FIG. 2, the two plugging members 80 present as pull tabs of the two zippers 8 of the luggage case (not shown). Each of the plugging members has a latch hole 81 for inserting into the opening 10 so as to be locked by the retainer 20 of the securing member 2.

Figure 4:
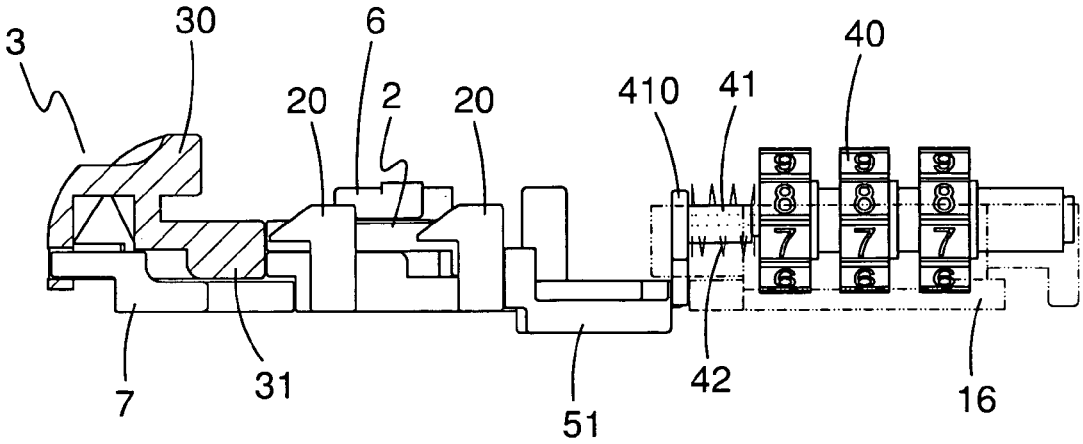
FIG. 4 is a side view of FIG. 3.

In FIGS. 3 and 4, each of the plugging members 80 is inserted in the opening 10 and remained in the retaining position where one end of restricting member 51 is blocked by the block 410 of the shaft 41. In this state, the latch holes 81 of the two plugging members 80 are inserted into the two openings 10 of the housing 1 and locked as a result of the incorrect codes of the combination lock. When the correct codes of the combination lock are dialed and the rotor 501 of the first locking device 5 is remained without any rotation, the retainers 20 of the securing member 2 are about ready for being moved away by the push-button 3 to the second releasing position, as described as follows.

Figure 5:
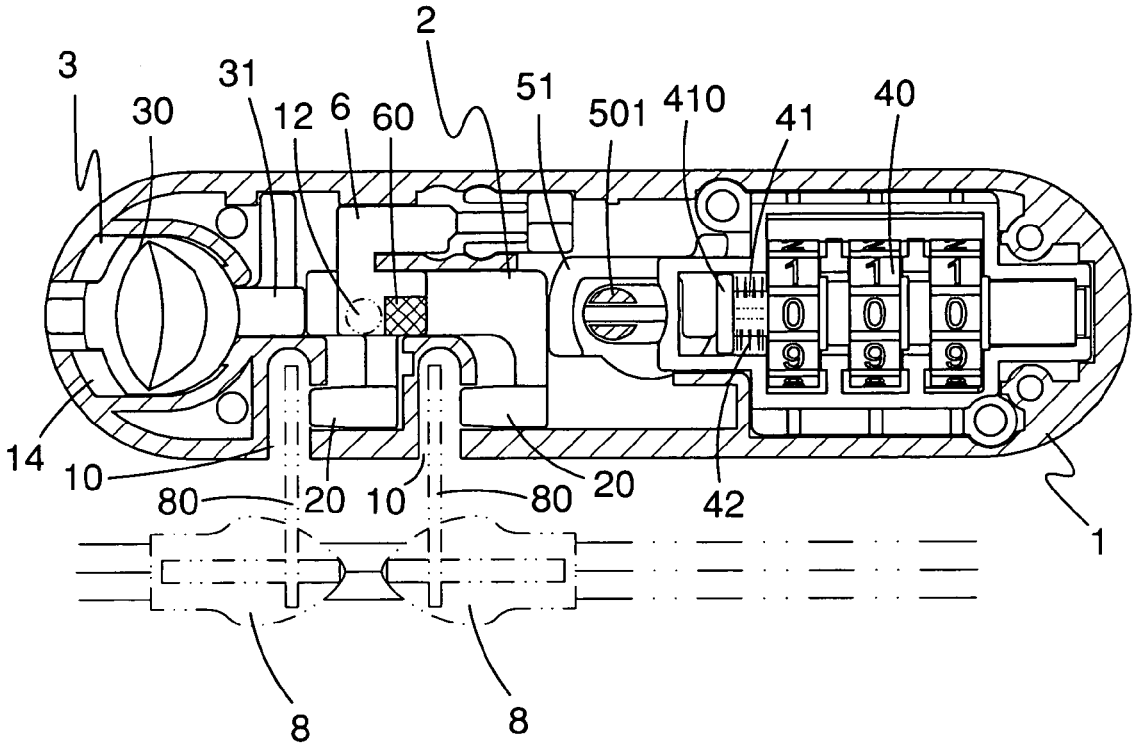
FIG. 5 shows that the dual locking device is unlocked via the combination lock according to the first embodiment.
Figure 6:
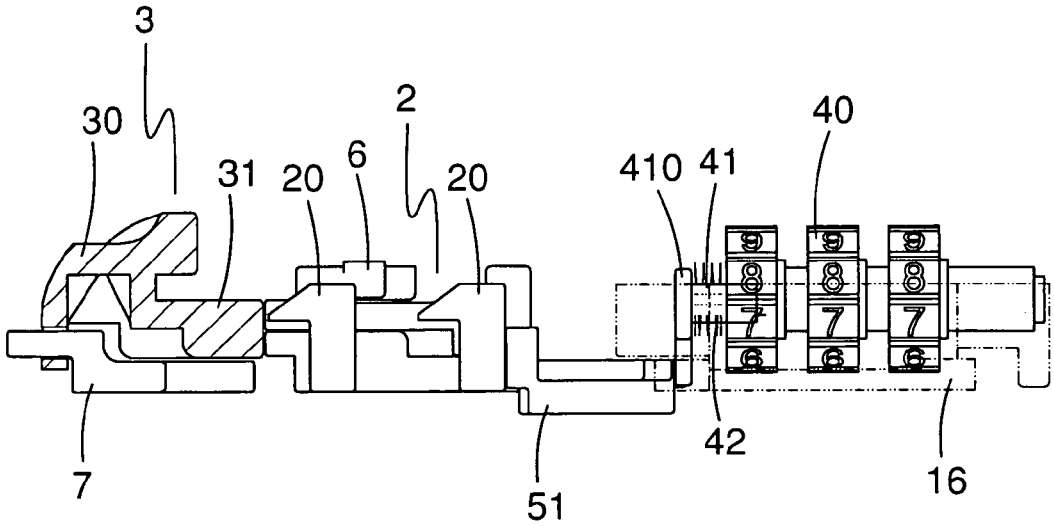
FIG. 6 is a side view of FIG. 5.

FIGS. 5 and 6 show how the second locking device 4 is used to unlock the dual locking device by controlling the movement of the restriction member 51 via a second route between the retaining position and a second releasing position. When the number wheel unit 40 is rotated and dialed to correct codes to allow the shaft 41 to move axially, the pushing portion 30 of the push-button 3 can be pushed within the broaden cavity 14 that the driving portion 31 of the push-button 3 can drive first the securing member 2 which then drives the restricting member 51 accordingly from the retaining position to the second releasing position to push the block 410. The block 410 then immediately propels the movable shaft 41 axially and presses the spring 42. At the same time, the retainers 20 of the securing member 2 have been moved to the unlocking position, off the openings 10 of the housing 1, and release the plugging members 80 from the openings 10.

Figure 7:
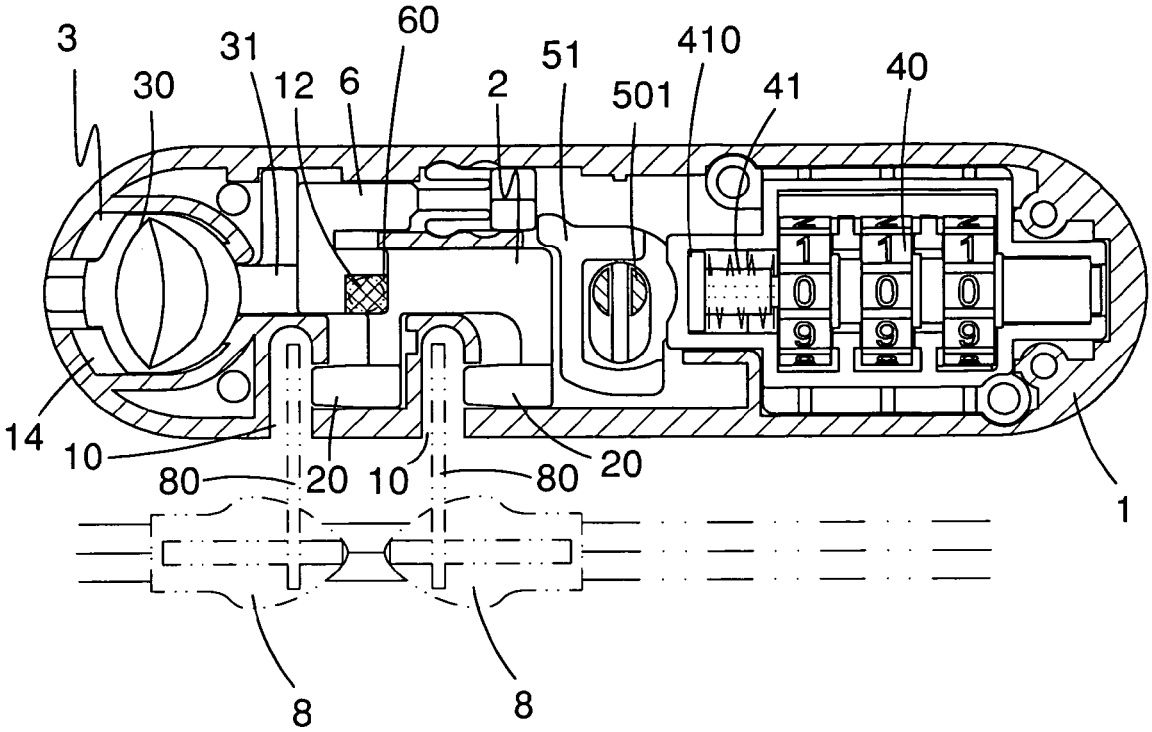
FIG. 7 shows that the dual locking device is unlocked via a key lock according to the first embodiment.
Figure 8:
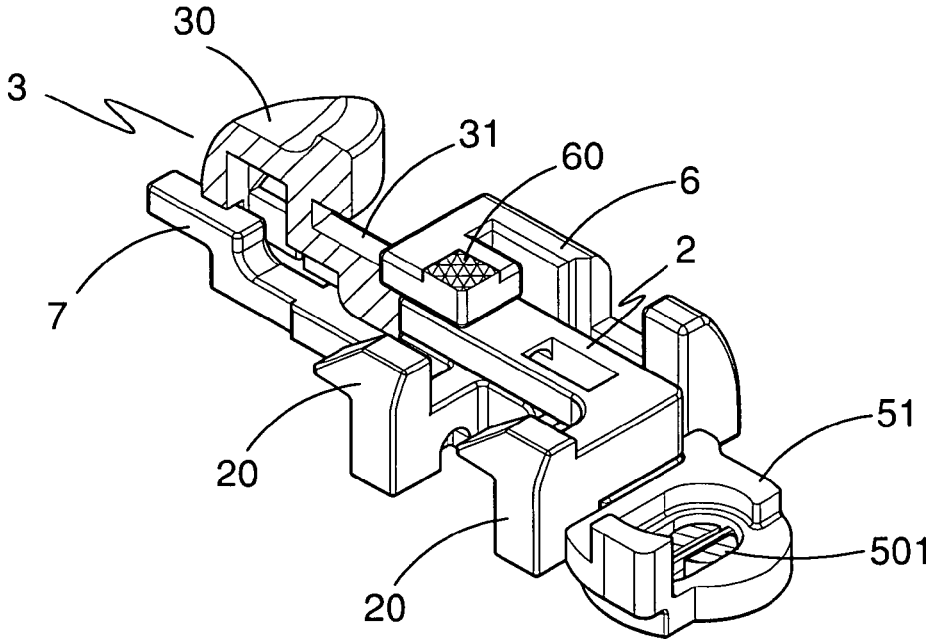
FIG. 8 is a regionally enlarged perspective view of FIG. 7.
Figure 9:
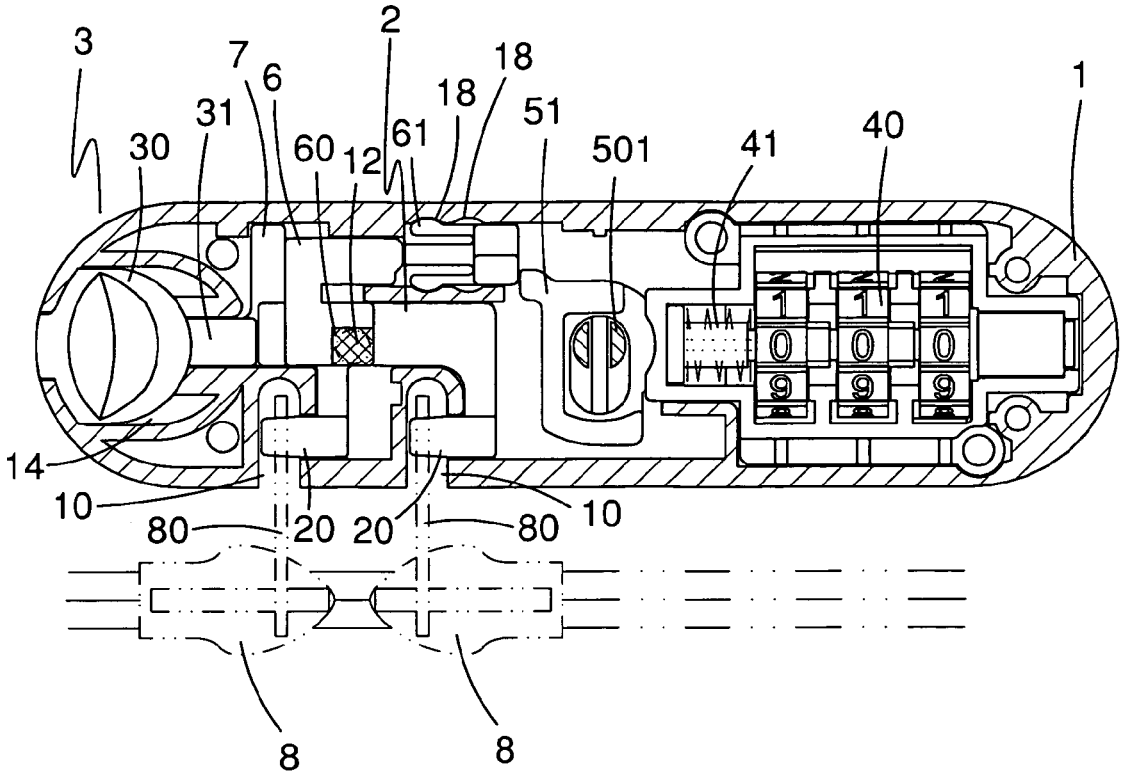
FIG. 9 shows a room being formed by turning the restricting member.

Next, FIGS. 7 to 9 describe how the first locking device 5 is used to unlock the dual locking device by controlling the movement of the restriction member 51 via the first route between the retaining position and the first releasing position. When the second locking device 4 is locked upon the incorrect codes that the shaft 41 can not move axially, the configured key (not shown) can be used to turn the rotor 501 to drive the restricting member 51 to rotate 90 degrees counterclockwise from the retaining position, as shown in FIG. 3, to the first releasing position, as shown in FIG. 9 that is recognized as the first route. In the meantime, a room next to the securing member 2 is formed in a result of the restricting member 51 not against the securing member 2 anymore so that the pushing portion 30 of the push-button 3 can be pushed accordingly and displaced within the broaden cavity 14, as shown in FIG. 7, that the driving portion 31 of the push-button 3 can drive the two retainers 20 of the securing member 2 to move to the unlocking position, off the openings 10 of the housing 1, so as to release the plugging members 80 from the openings 10. Therefore, an inspector can hold the configured key to check the luggage without damage the same via the first locking device 5.

Referring back to FIG. 1, the dual locking device according to the first embodiment may further comprise an indicator 6 installed in the housing 1 and a reposition device 7 received in the passage 32 of the push-button 3. The reposition device 7 has an end in proximity to a side of the indicator 6, which can be moved either to display an identification member 60 thereof through the window 12 of the housing 1 or to make the identification member 60 come off the window 12 for hiding the identification member 60.

Figure 10:
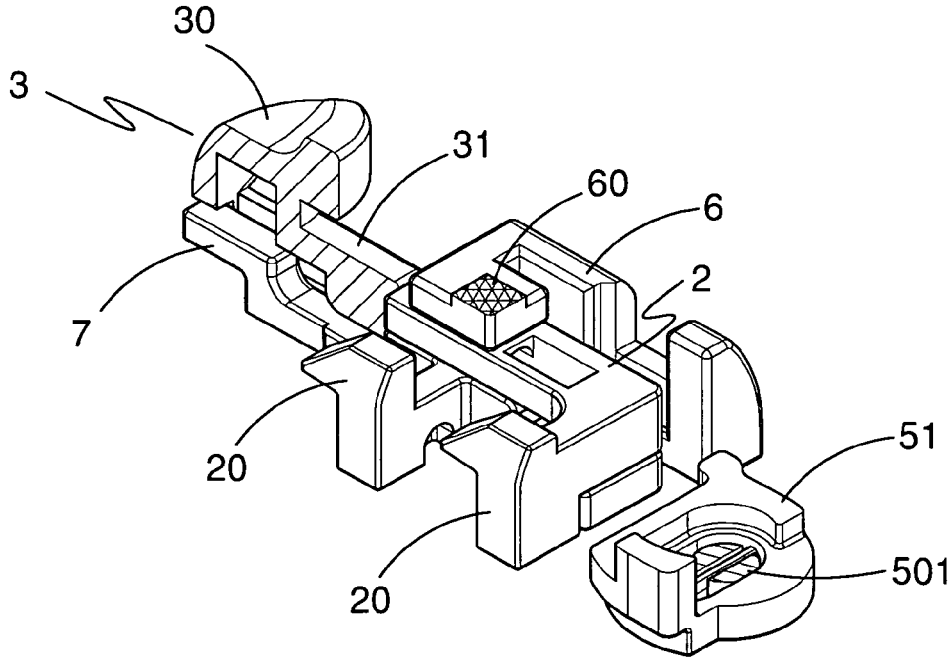
FIG. 10 is a regionally enlarged perspective view of FIG. 9.
Figure 11:
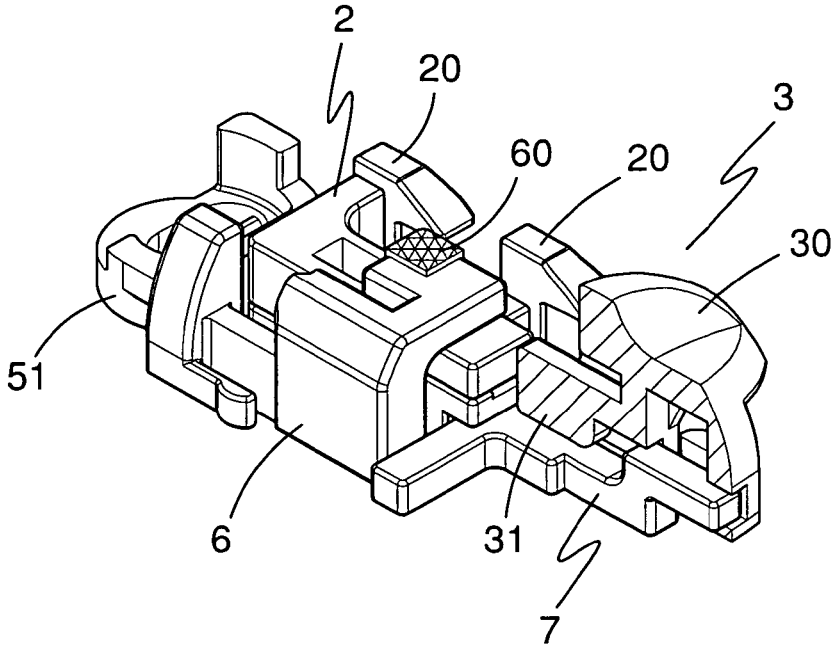
FIG. 11 is an opposite view of FIG. 10.

In FIGS. 9 to 11, when rotating 90 degrees counterclockwise to the first releasing position, the restricting member 51 pushes an end of the indicator 6 to expose the identification member 60 from the window 12 of the housing 1 where the other end of the indicator 6 is against an end of the reposition device 7. Accordingly, an owner of the case can identify whether the case has been checked by others, such an inspector of the Customs.

Figure 12:
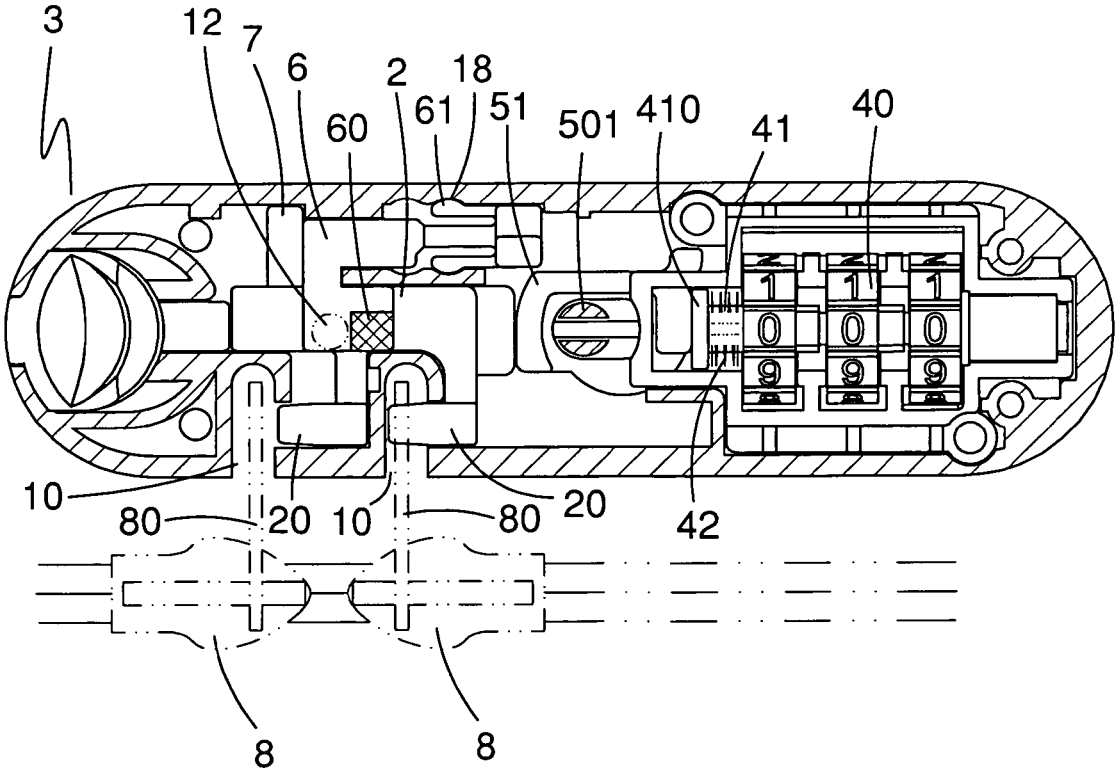
FIG. 12 shows a reposition device being used to restore an indicator according to the first embodiment.
Figure 13:
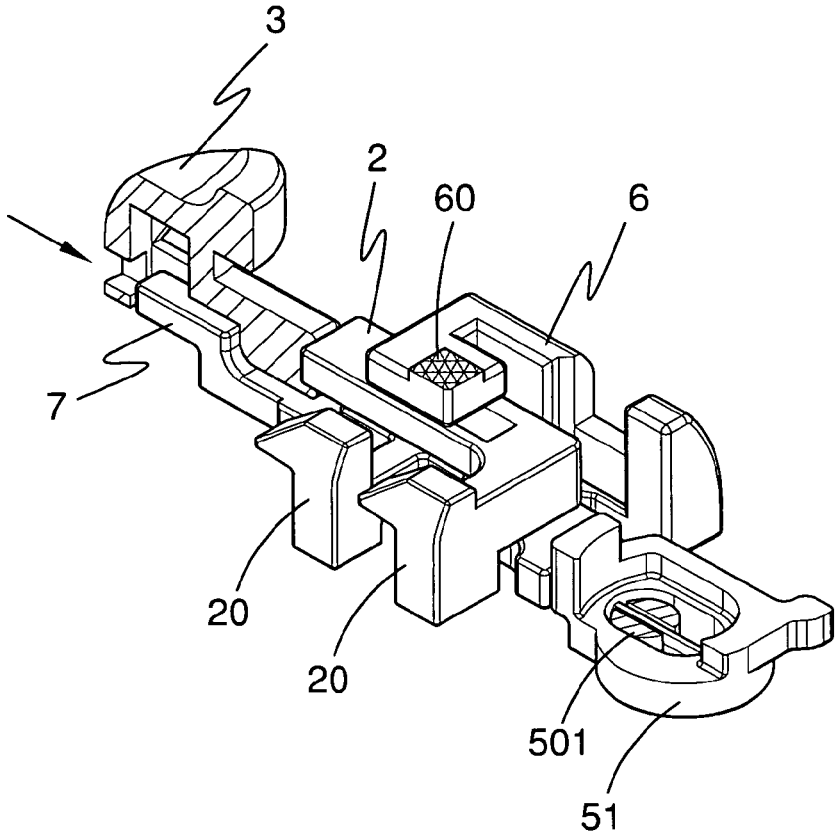
FIG. 13 is a regionally enlarged perspective view of FIG. 12.
Figure 14:
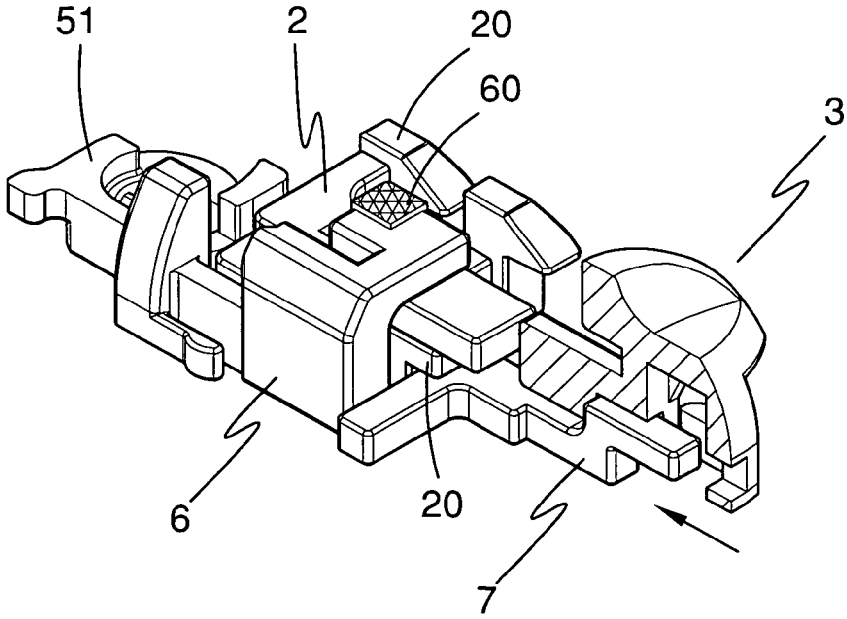
FIG. 14 is an opposite view of FIG. 13.

FIGS. 12 to 14 show that the identification member 60 of the indicator 6 is displaced from the window 12 of the housing 1. When both the correct codes of the combination lock are dialed and the rotor 501 is rotated to drive the restricting member 51 back to the retaining position, the other end of the reposition device 7 can be pushed from the passage of the push-button 3 so that the reposition device 7 is driven first to push the nearest retainer 20 which then pushes the block 410 accordingly. Next, the block 410 continually propels the shaft 41 axially and presses the spring 42. In this time, the retainers 20 of the securing member 2 come off the opening 10 of the housing 1 to release the pull tabs 80 from the openings 10 and the indicator 6 is propelled back to a position where the identification member 60 of the indicator 6 is hidden, not being displayed through the window 12 of the housing 1.

As shown in FIGS. 9 and 12, the housing 1 can further include two positioning notches 18 and the indicator 6 can further include a protrusion 61 formed a side thereof. Thus, when the indicator 6 is moved to display or hide the identification member 60 through the window 12 of the housing 1, the protrusion 61 can be positioned in one of the two positioning notches 18.

With reference to FIGS. 15 to 20, a second embodiment, which shows a dual locking device of the present invention, is described as below.

Comparing with the first embodiment, the second embodiment has no the reposition device 7. Instead, a push button **3*a* of the second embodiment is arranged to have a first route for driving a securing member 2*a* to unlock the dual locking device and a second route after the first route for pushing an indicator 6*a*** back to an original position.

Figure 15:
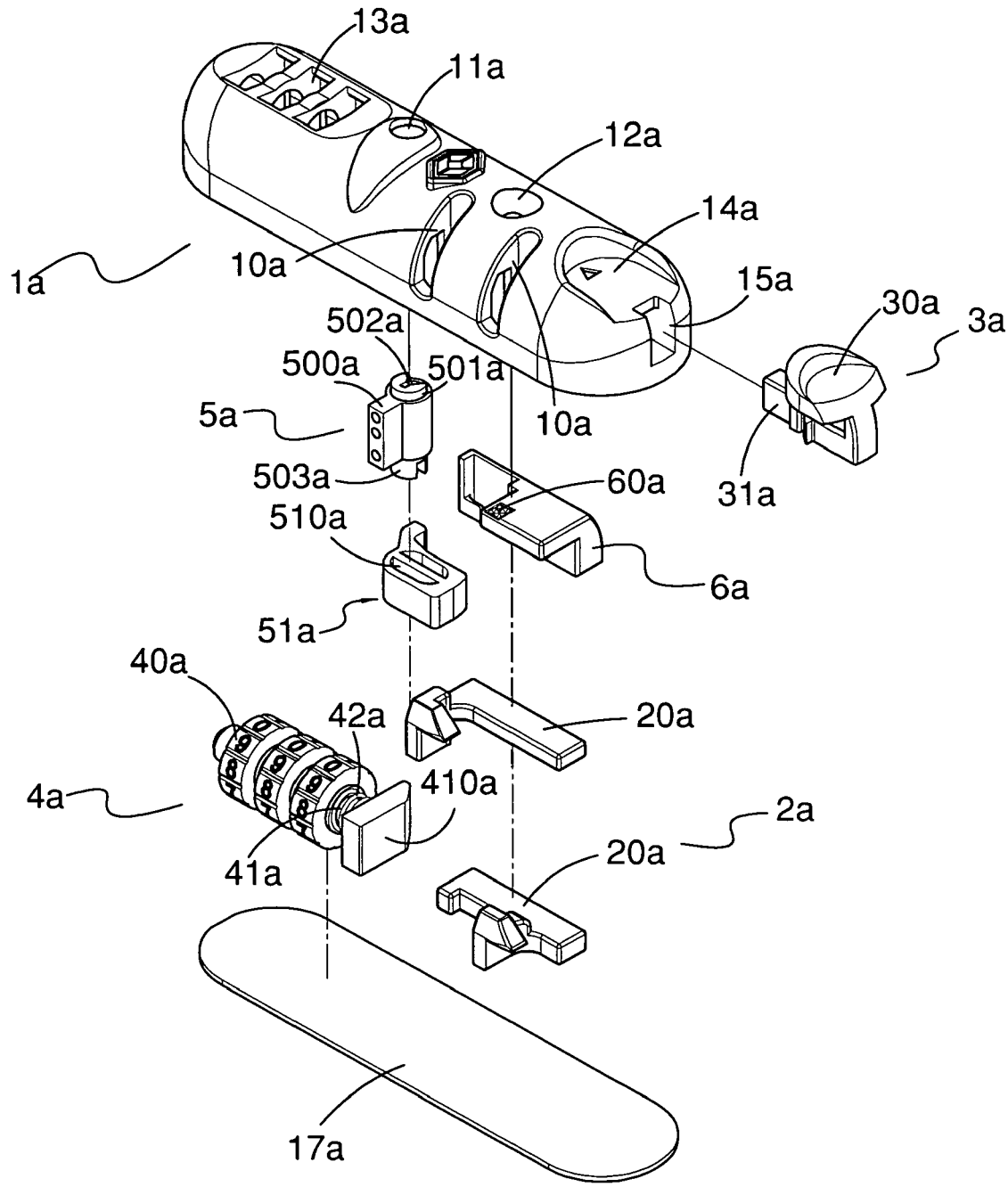
FIG. 15 is an exploded perspective view of a dual locking device in accordance with a second embodiment of the present invention.

Referring now to FIG. 15, the dual locking device in accordance with the second embodiment comprises a housing **1*a*, a switching mechanism, a restriction member 51*a*, a first locking device 5*a*, and a second locking device 4*a*. Additionally, the switching mechanism includes the push-button 3*a* and the securing member 2*a***.

Figure 16:
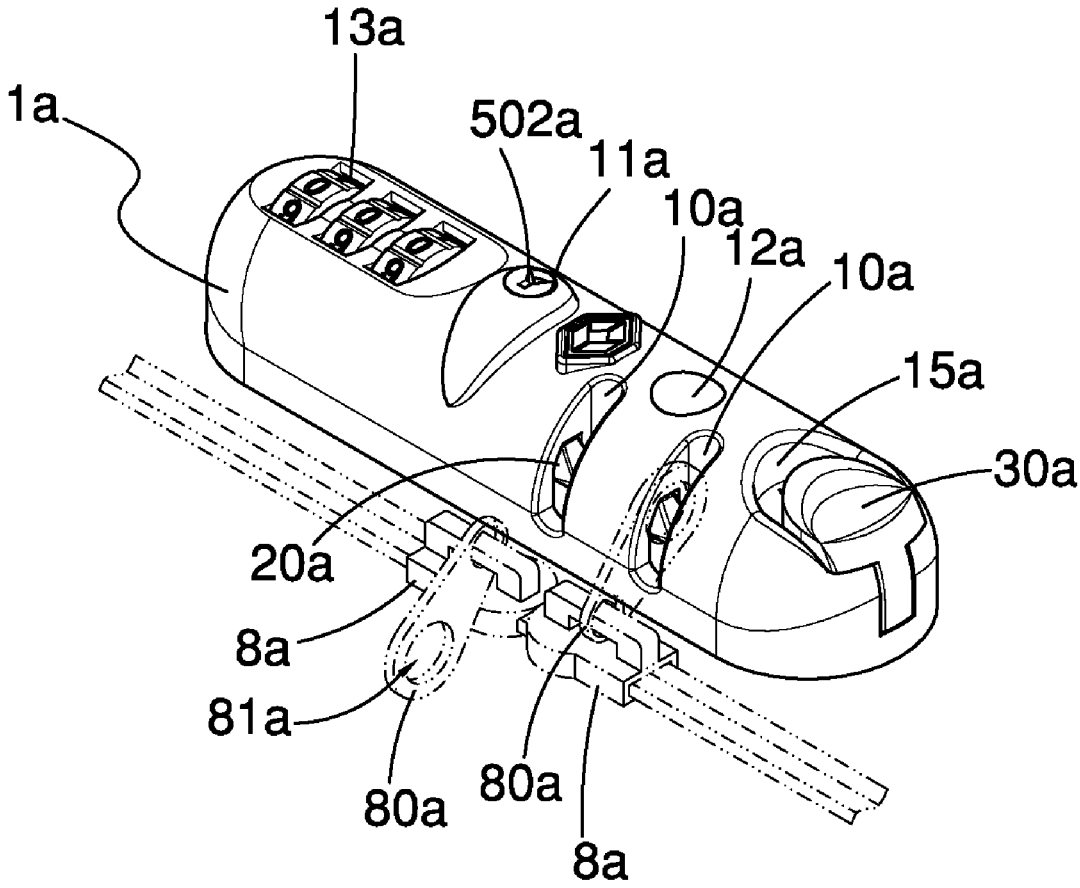
FIG. 16 is a perspective assembly view of FIG. 15.

Similarly to the first embodiment, the housing **1*a* has a top formed with two openings 10*a* communicating with the interior of the housing 1*a* for inserting the plugging member 80*a* as shown in FIG. 16. The housing 1*a* also has a through hole 11*a*, a window 12*a* and a plurality of number wheel slots 13*a*, and has a side formed with a broaden cavity 14*a* having a channel 15*a* communicating with the interior of the housing 1*a*. A base 17*a* may be disposed at a bottom of the housing 1** for covering the same.

The securing member **2*a* of the switching mechanism is mounted in the housing 1*a* and includes two retainers 20*a* overlapped with each other. The two retainers 20*a* can move together to a locking position or an unlocking position while being driven so as to block or open the openings 10*a* of the housing 1*a*** respectively.

The push-button **3*a* in relation with the securing member 2*a* has a pushing portion 30*a* movably mounted on the broaden cavity 14*a*, a driving portion 31*a* received in the channel 15*a* of the housing 1*a* and against a side of the securing member 2*a*. Thus, the retainers 20*a* of the securing member 2*a* can be driven to come off the openings 10*a* by pushing the push-button 3*a* from the outside of the housing 1*a***.

The first locking device **5*a* and the second locking device 4*a* are provided for controlling the movement of the restriction member 51*a*. In the second embodiment, a key lock and a combination lock, as examples, serve respectively as the first locking device 5*a* and the second locking device 4*a***.

The first locking device **5*a*, namely the key lock, has a rotor 501*a*, a sleeve 500*a* fixed on the housing 1*a* and received the rotor 501*a* which has an end formed with a key hole 502*a* exposed the outside of the through hole 11*a* of the housing 1*a* for being operated by a configured key (not shown) and has another end formed with a rider 503*a***.

The restricting member **51*a* installed in the housing 1*a* has a cave 510*a* for receiving the rider 503*a* of the rotor 501*a* and a rail 511*a* formed in the cave 510*a* so that the restricting member 51*a* can be rotated by rotating the rotor 501*a* via the configured key through the first route between a retaining position and a first releasing position. In the retaining position, the restricting member 51*a* is confined between the securing member 2*a* and a block 410*a* of the second locking device 4*a*, as shown in FIG. 16, and the securing member 2*a* thereby is blocked in the locking position. When the restricting member 51*a* is rotated to the first releasing position, the securing member 2*a* is allowed to move to the unlocked position. Instead of rotation, the restricting member 51*a* can move relative to the rider 503*a* of the rotor 501*a* to a second releasing position in a result of the sliding of the rail 511***a* ridden by the rider 503*a* of the rotor 501*a*.

The second locking device 4*a*, namely the combination lock, is mounted in the housing 1*a* and has a number wheel unit 40*a* partly exposed the outside of the number wheel slot 13*a*, a movable shaft 41*a* passing through the number wheel unit 40*a*. The shaft 41*a* is movable axially when a set of correct codes to the second locking device 4*a* are dialed and is fixed when the codes are incorrect. Furthermore, the movable shaft 41*a* has an end formed with the block 410*a* which is slidable along a specific range. The second locking device 4*a* further has a spring 42*a* which is around the movable shaft 41*a* and has one end against a side of the number wheel unit 40*a* and the other end against a back side of the block 410*a*.

As shown in FIG. 16, the plugging members 80*a* present as pull tabs of the two zippers 8*a* of the luggage case (not shown). Each of the plugging members 80*a* has a latch hole 81*a* for inserting into the opening 10*a* so as to be locked by the retainers 20*a* of the securing member 2*a*.

Figure 17:
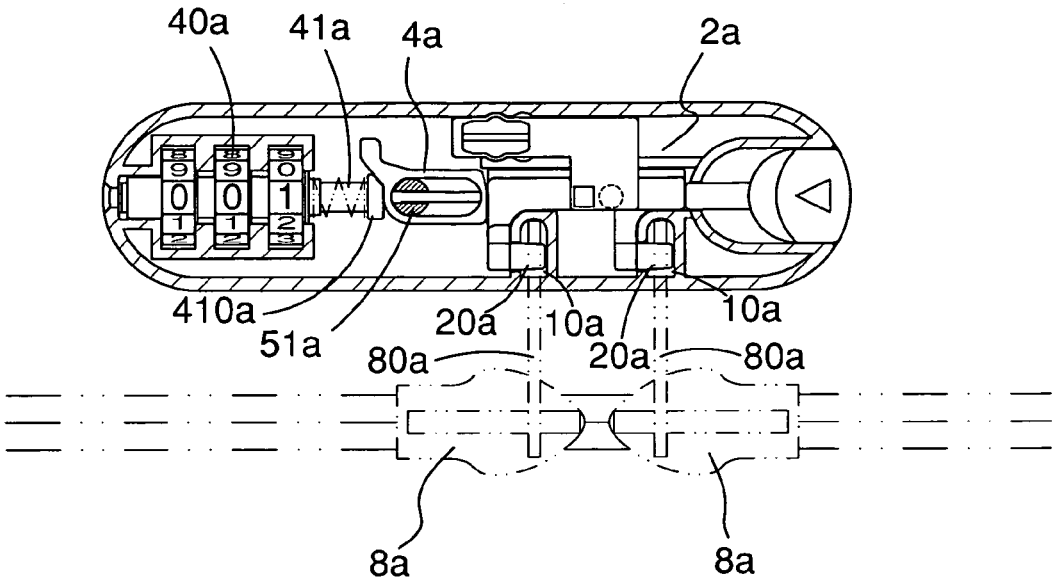
FIG. 17 shows that a restricting member is blocked between a combination lock and a push button according to the second embodiment.

Referring now to FIG. 17, each of the plugging members 80*a* is inserted into the opening 10*a*. When the second locking device 4*a* is locked and the rotor 501*a* of the key lock 5*a* can not been rotated, the restricting member 51*a* remains in the retaining position where one end of the restricting member 51*a* is blocked by the block 410*a* of the movable shaft 41*a* so that the two retainers 20*a* of the securing member 2*a* can not be moved by pushing the push-button 3*a*. In the meantime, the two latch holes 81*a* of the plugging members 80*a* can be inserted into the two openings 10*a* of the housing 1*a* so as to be locked.

Figure 18:
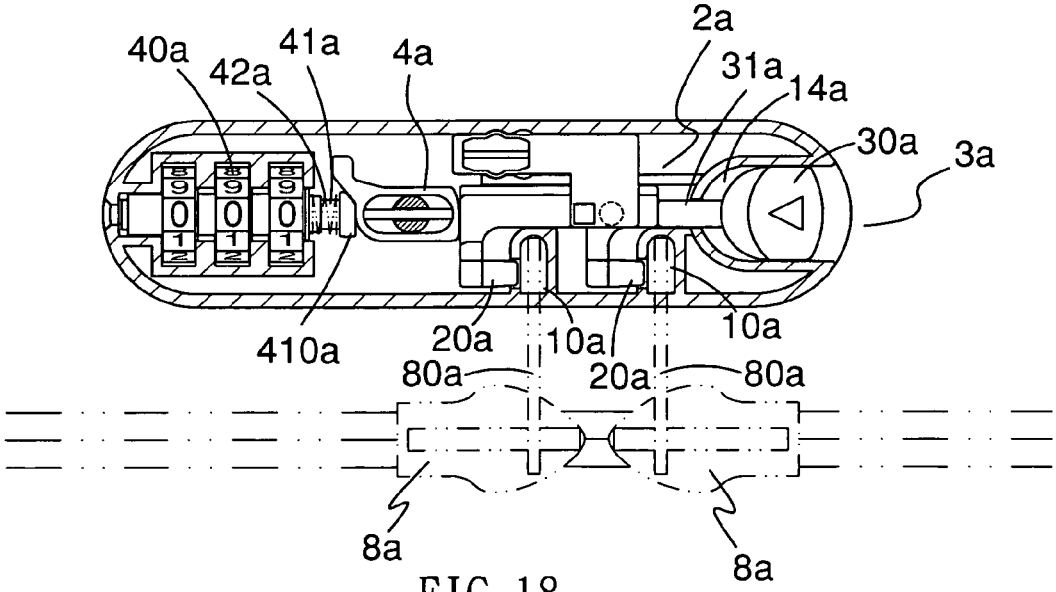
FIG. 18 shows that the dual locking device is unlocked via the combination lock according to the second embodiment.

FIG. 18 shows how the second locking device 4*a* is used to unlock the dual locking device by controlling the movement of the restriction member 51*a* via the second route between the retaining position and a second releasing position. When the number wheel unit 40*a* is rotated and the correct codes are dialed to allow the shaft 41*a* to move axially, the pushing portion 30*a* of the push-button 3*a* can be pushed within the broaden cavity 14*a* that the driving portion 31*a* of the push-button 3*a* can drive the securing member 2*a* which then drives the restricting member 51*a* from the retaining position to the second releasing position to push the block 410*a*. The block 410*a* then immediately propels movable shaft 41*a* axially and presses the spring 42*a*. At the same time, the retainers 20*a* of the securing member 2*a* have been moved to the unlocking position, off the openings 10*a* of the housing 1*a*, and released the plugging members 80*a* from the openings 10*a*.

Figure 19:
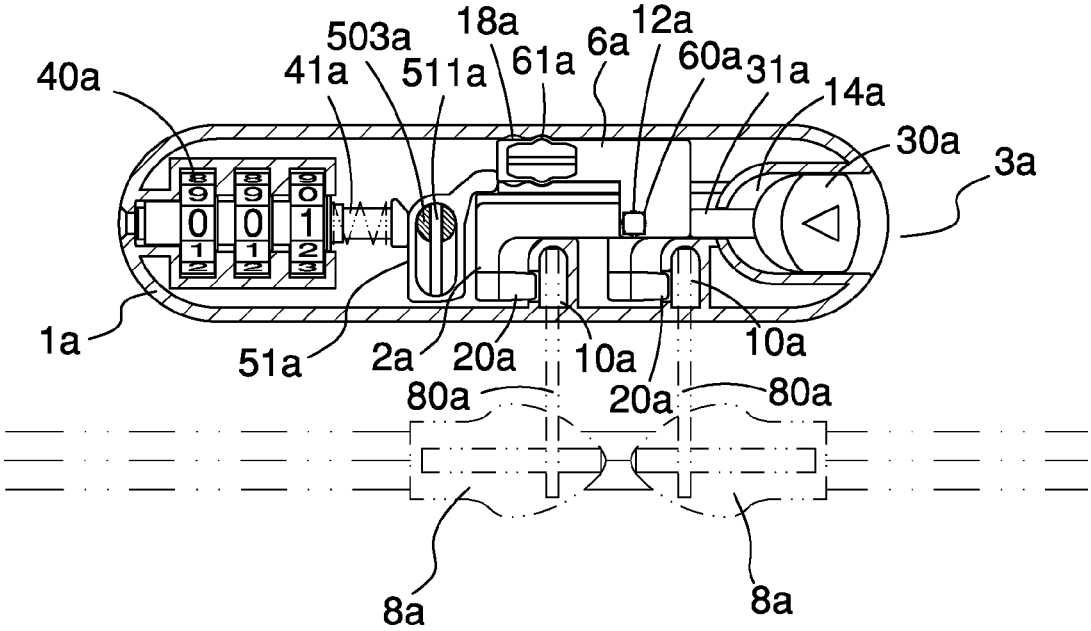
FIG. 19 shows that the dual locking device is unlocked via a key lock according to the second embodiment.

Next, FIG. 19 shows how the first locking device 5*a* is used to unlock the dual locking device by controlling the movement of the restriction member 51*a* via the first route between the retaining position and the first releasing position. When the combination lock 4*a* is locked that the shaft 41*a* can not move axially, the configured key (not shown) can be turned to rotate the rotor 501*a* so as to drive the restricting member 51*a* to rotate 90 degrees counterclockwise from the retaining position to the first releasing position that is recognized as the first route. In the meantime, a room next to the securing member 2*a* is formed in a result of the restricting member 51*a* not against the securing member 2*a* anymore so that the pushing portion 30*a* of the push-button 3*a* can be pushed and displaced within the broaden cavity 14*a* that the driving portion 31*a* of the push-button 3*a* can drive the retainers 20*a* of the securing member 2*a* to move to the unlocking position, off the openings 10*a* of the housing 1*a*, so as to release the plugging members 80*a* from the openings 10*a*, similarly to the first embodiment.

In FIG. 15, the dual locking device according to the second embodiment can also comprise the indicator 6*a* installed in the housing. The indicator 6*a* can be moved either to display an identification member 60*a* through the window 12*a* of the housing 1*a* or to make the identification member 60*a* come off the window 12*a* for being hidden.

Referring to FIG. 19, when rotating the restricting member 51*a* to 90 degrees clockwise to the first releasing position, a rod 511*a* extended from the restricting member 51*a* is turned to push an end of the indicator 6*a* to expose the identification member 60*a* in the window 12*a* of the housing 1*a*. Accordingly, an owner of a case with the dual locking device may identify whether the case was checked by others, such an inspector of the Customs.

Figure 20:
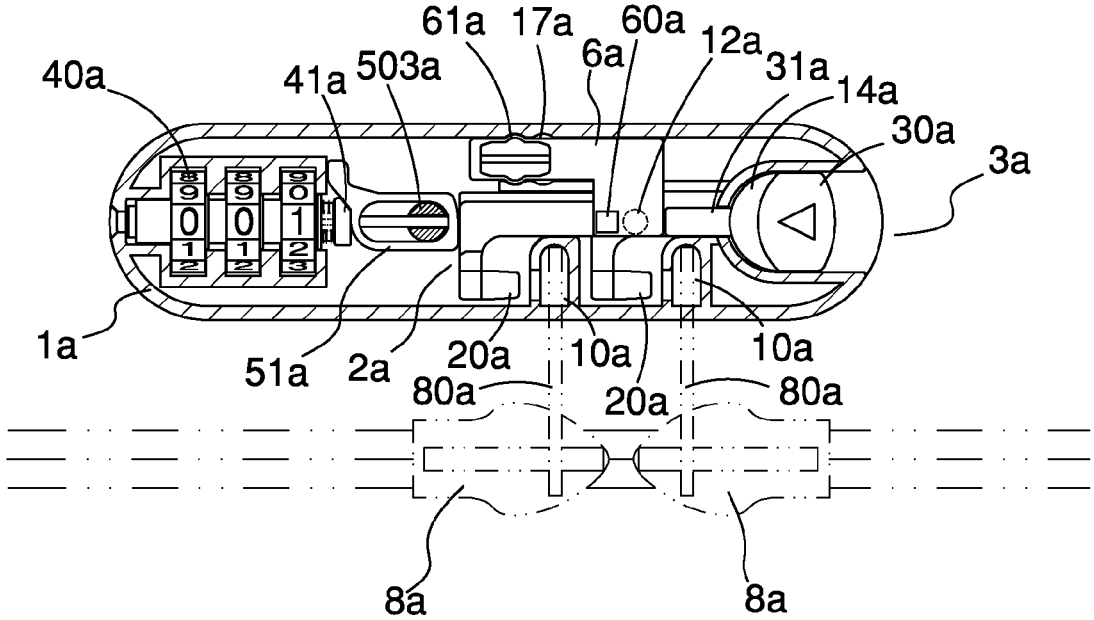
FIG. 20 shows that a push-button is used to restore an indicator according to the second embodiment.

In FIG. 20, the identification member 60*a* of the indicator 6*a* is displaced from the window 12*a* of the housing 1*a*. When the correct codes of the combination lock are dialed and the rotor 501*a* is rotated to drive the restricting member 51*a* back to the retaining position, and by pushing the push-button 3*a*, the driving portion 31*a* of the push-button 3*a* can first be pushed to drive the retainers 20*a* of the securing member 2*a* to come off the opening 10*a* of the housing 1*a* so as to release the plugging members 80*a*. The driving portion 31*a* can further be pushed to propel the indicator 6*a* back to the original position where the identification member 60*a* of the indicator 6*a* is hidden, not being displayed through the window 12*a* of the housing 1*a*.

As shown in FIGS. 17 to 20, the housing 1*a* can further include two positioning notches 18*a* and the indicator 6*a* can further include a protrusion 61*a*. Thus, when the indicator 6*a* is displaced to display or hide the identification member 60*a* from the window 12*a* of the housing 1*a*, the protrusion 61*a* can be positioned in one of the two positioning notches 18*a*.

FIGS. 21 to 27 show a dual locking device as a third embodiment of the present invention and the structures of the third embodiment are similar to the above embodiments.

Figure 21:
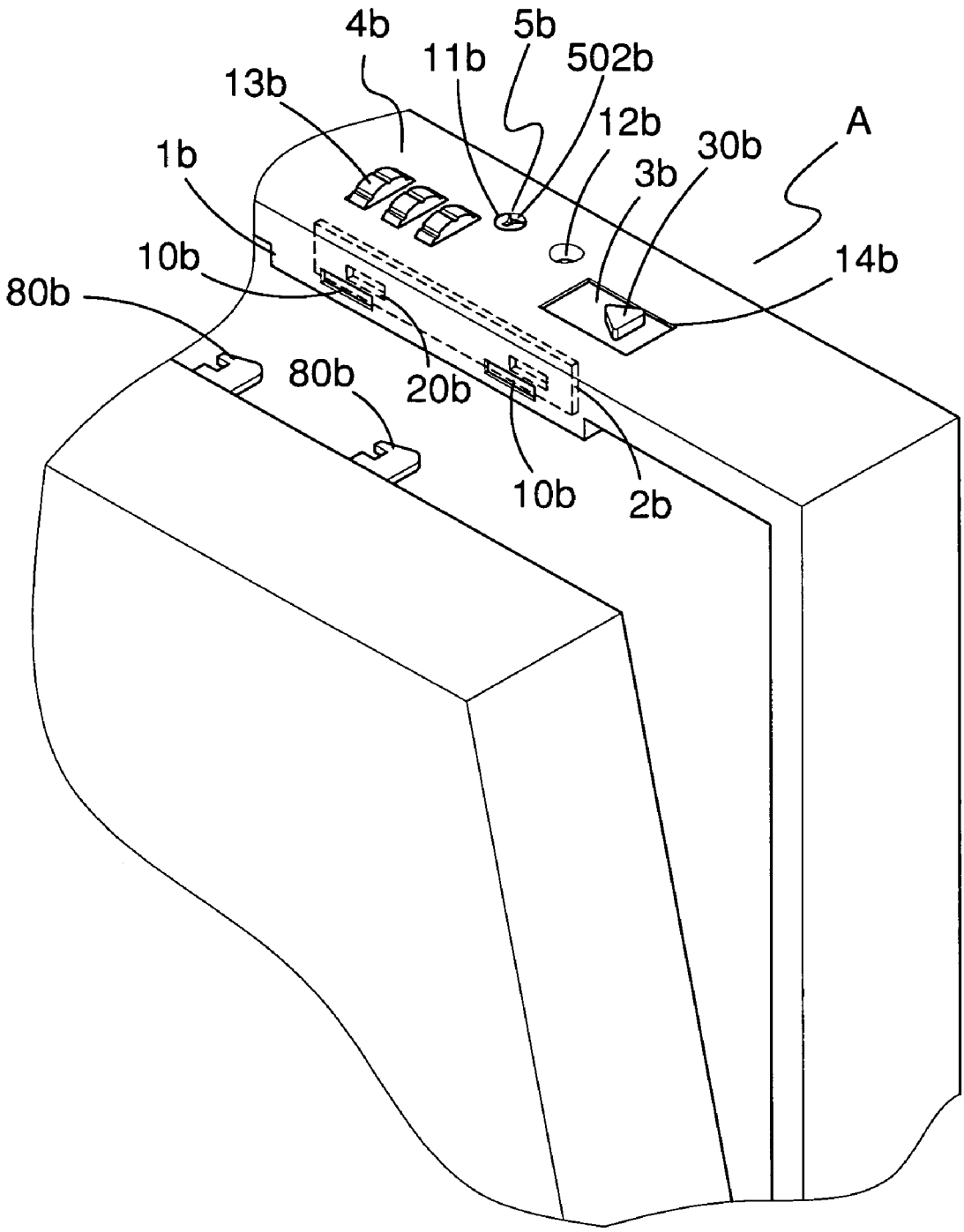
FIG. 21 is a perspective view of a dual locking device in accordance with a third embodiment of the present invention.
Figure 22:
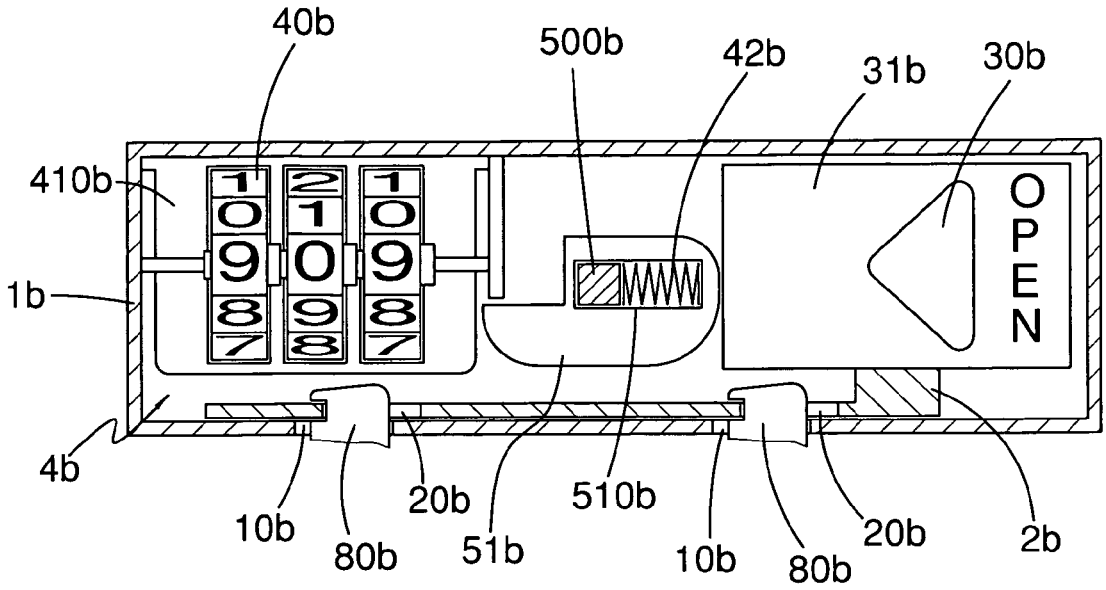
FIG. 22 shows that a restricting member is blocked between a combination lock and a push-button according to the third embodiment.
Figure 23:
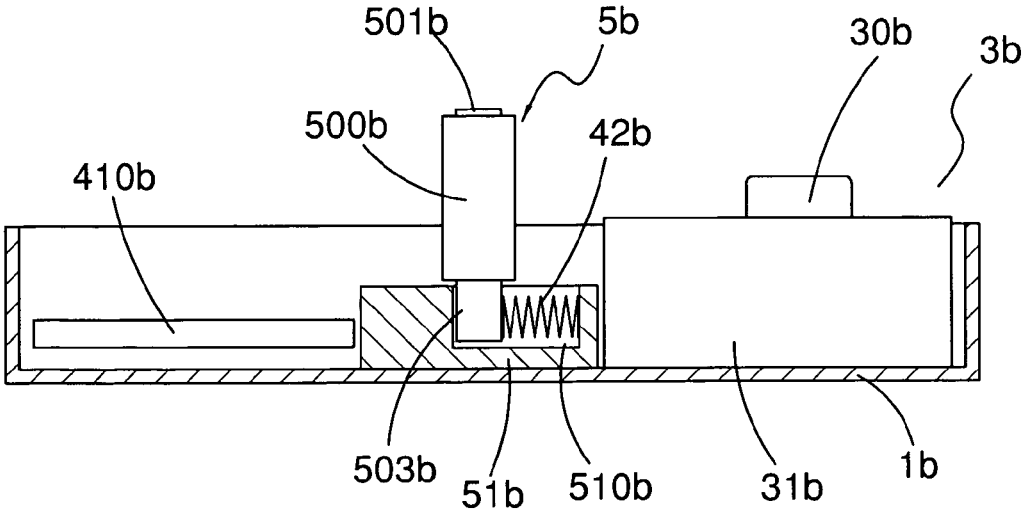
FIG. 23 is a side view of the FIG. 22.

Referring now to FIGS. 21 to 23, the dual locking device according to the third embodiment comprises a housing 1*b*, a switching mechanism, a restriction member 51*b*, a first locking device 5*b*, and a second locking device 4*b*. Additionally, the switching mechanism includes a push-button 3*b* and a securing member 2*b*.

The housing 1*b* has a side formed with two openings 10*b* communicating with the interior of the housing 1*b* for receiving a plugging member 80*b*. The housing 1*b* has a top formed with a through hole 11*b*, a window 12*b* and a plurality of number wheel slots 13*b*, and has another side formed with a broaden cavity 14*b* having a channel (not shown) communicating with the interior of the housing 1*b*.

The securing member 2*b* of the switching mechanism is mounted in the housing 1*b* and includes two retainer openings 20*b*, (instead of the retainers 20 or 20*a* of the above embodiments), formed in the securing member 2*b*. The retaining openings 20*b* along with the securing member 2*b* can move to a locking position or an unlocking position so as to block or open the openings 10*b* of the housing 1*b* respectively.

The push-button 3*b* in relation with the securing member 2*b* has a pushing portion 30*b* movably mounted on the broaden cavity 14*b*, a driving portion 31*b* received in the channel of the housing 1*b* and connected with a side of the securing member 2*b*. Thus, the retaining openings 20*b* of the securing member 2*b* can be driven to come off the openings 10*b* by pushing the push-button 3*b* from the outside of the housing 1*b*.

The first locking device 5*b* and the second locking device 4*b* are provided for controlling the movement of the restriction member 51*b*. In this third embodiment, a key lock and a combination lock, as examples, serve respectively as the first locking device 5*b* and the second locking device 4*b*.

The first locking device 5*b*, namely the key lock, has a rotor 501*b*, a sleeve 500*b* fixed on the housing 1*b* and received the rotor 501*b* which has an end formed with a key hole 502*b* exposed the outside of the through hole 11*b* of the housing 1*b* for being operated by a configured key (not shown) and has another end formed with a rider 503*b* in a square shape.

Figure 25:
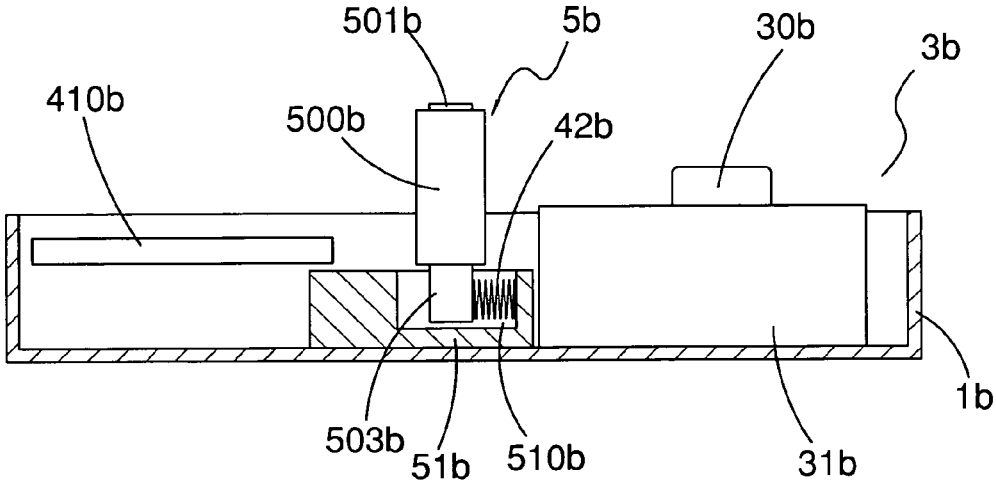
FIG. 25 is a side view of the FIG. 24.

The restricting member 51*b* installed in the housing 1*b* has a cave 510*b* in rectangle shape for mating with the rider 503*b* of the rotor 501*b* so that the restricting member 51*b* can be rotated by rotating the rotor 501*b* via the configured key through a first route between a retaining position and a first releasing position. In the retaining position, the restricting member 51*b* is confined between the push-button 3*b* and a block 410*b* of the second locking device 4*b*, as shown in FIG. 23, and the push-button 3*b* thereby can not move to drive the securing member 2*b* that the retaining openings 20*b* of the securing member 2*b* remain in the locking position. When the restricting member 51*b* is rotated to the first releasing position, the push-button 3*b* thereby is allowed to be pushed to drive the retaining openings 20*b* to an unlocking position. Instead of rotation, the cave 510*b* of the restricting member 51*b* is in rectangle shape that the restricting member 51*b* can slide in relative to the rider 503*b* of the rotor 501*b* to a second releasing position, as shown in FIG. 25.

The second locking device 4*b*, namely the combination lock 4*b*, is mounted in the housing 1*b* and has a number wheel unit 40*b* partly exposed the outside of the number wheel slot 13*b*, and the block 410*b* is next to the number wheel unit 40*b*. The block 410*b* is movable vertically when a set of correct codes to the combination lock are dialed and is fixed when the incorrect codes are dialed. When the combination lock is unlocked and the block 410*b* is accordingly displaced to an upper position, the restriction member 51*b* is allowed to move toward the second locking device 4*b*, and a room is formed for the movement of the push-button 3*b*, as shown in FIG. 25. Reversely, when the combination lock is locked and the block 410*b* is displaced to a lower position, the restriction member 51*b* is blocked, no room exists for the movement of the push-button 3*b*, as shown in FIG. 23.

As shown in FIG. 21, two plugging members 80*b* present as hooks of a luggage case. Each of the plugging members 80*b* can be inserted into the opening 10*b* to be locked by the retaining openings 20*b* of the securing member 2*b*.

In FIGS. 22 and 23, each of the plugging members 80*b* is inserted into the opening 10*b*. When the correct codes of the second locking device 4*b* are not dialed and the rotor 501*b* of the key lock 5*b* has not been rotated, the restricting member 4*b* remains in the retaining position where one end of the restriction is blocked by the block 410*b* of the second locking device 4*b* so that the two retaining holes 20*b* of the securing member 2*b* can not be moved by pushing the push-button 3*b*. In the meantime, the plugging members 80*b* are locked by the retaining openings 20*b* of the securing member 2*b*.

Figure 24:
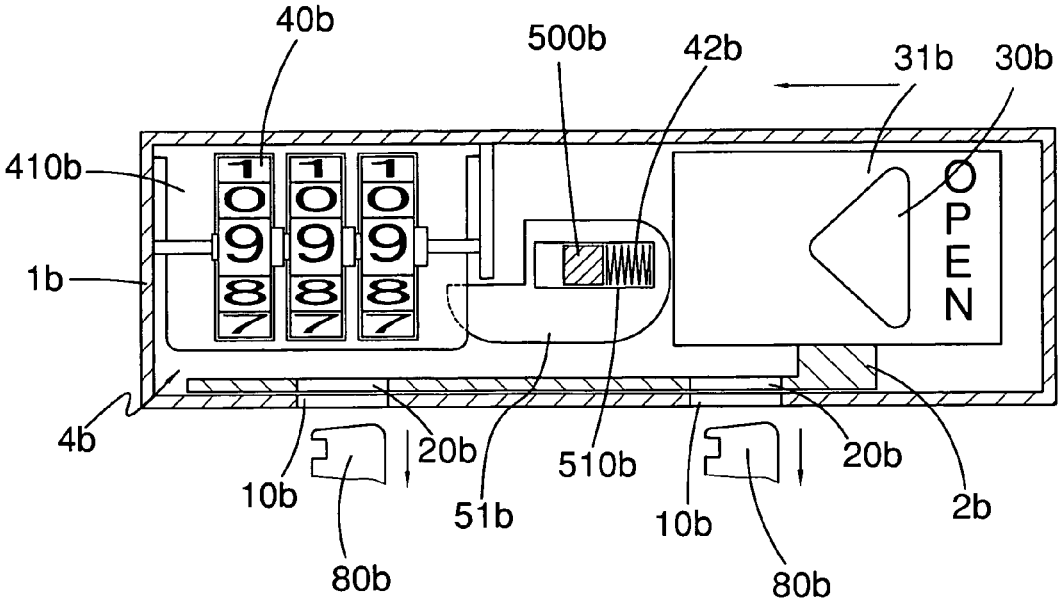
FIG. 24 shows that the dual locking device is unlocked via the combination lock according to the third embodiment.

FIGS. 24 and 25 show the second locking device 4*b* is used to unlock the dual locking device by controlling the movement of the restriction member 51*b* via a second route between the retaining position and a second releasing position. When the number wheel unit 40*b* is rotated to the correct codes to displace vertically the block 410*b* to the upper position, the pushing portion 30*b* of the push-button 3*b* can be pushed within the broaden cavity 14*b* that the driving portion 31*b* of the push-button 3*b* can drive the securing member 2*b* and then drives the restricting member 51*b* from the retaining position to the second releasing position to have the restricting member 51*b* under the block 410*b*. At this time, by pushing the push-button 3*b*, the retaining openings 20*b* of the securing member 2*b* have been moved accordingly to the unlocking position, off the openings 10*b* of the housing 1*b*, and to release the plugging members 80*b*.

Figure 26:
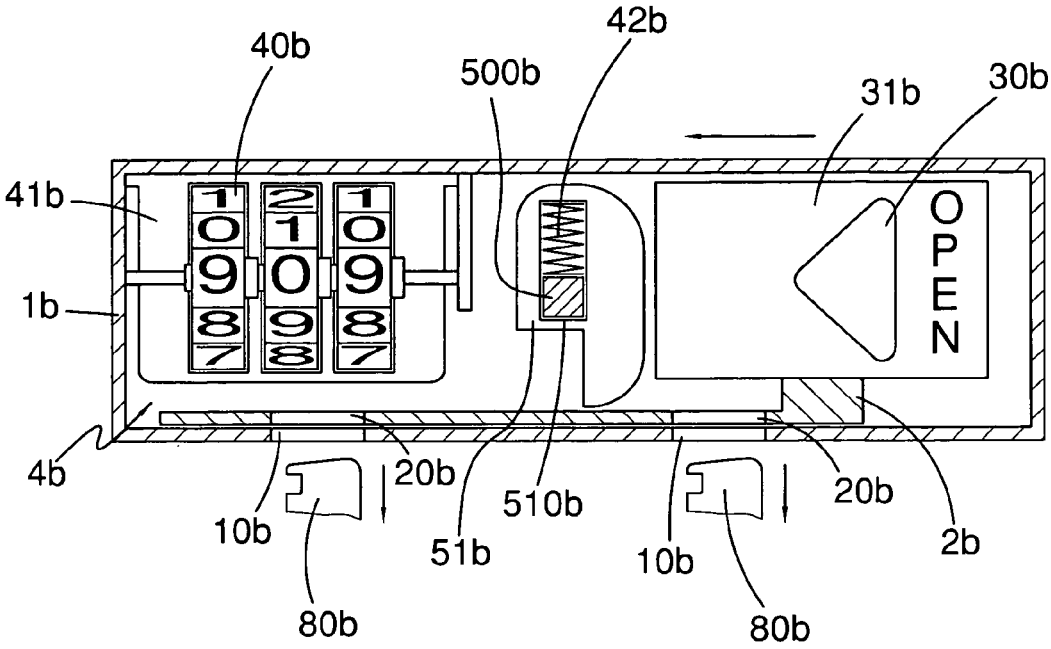
FIG. 26 shows that the dual locking device is unlocked via a key lock according to the third embodiment.
Figure 27:
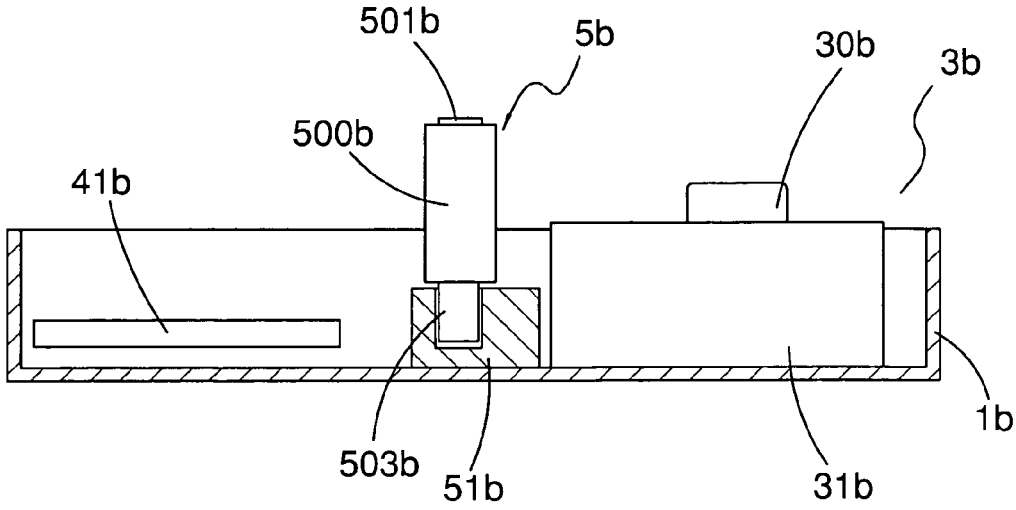
FIG. 27 is a side view of the FIG. 26.

FIGS. 26 and 27 show how the first locking device 5*b* is used to unlock the dual locking device by controlling the movement of the restriction member 51*b* via the first route between the retaining position and the first releasing position. When the correct codes of the combination lock 4*b* are not dialed that causes the block 410*b* can not move vertically, the configured key (not shown) is used to turn the rotor 501*b* to drive the restricting member 51*b* to rotate 90 degrees from the retaining position to the first releasing position, as recognized as the first route. In the meantime, the pushing portion 30*b* of the push-button 3*b* can be pushed and displaced within the broaden cavity 14*b* that causes the driving portion 31*b* of the push-button 3*b* can drive the retaining openings 20*b* of the securing member 2*b* to move to the unlocking position, off the openings 10*b* of the housing 1*b*, so as to release the plugging members 80*b* from the openings 10*b*.

Moreover, the dual locking device in the third embodiment can further comprises an indicator (not shown) installed in the housing and exposed an identification member (not shown) from the window 12*a* of the housing as illustrated in the above embodiments.

Figure 28:
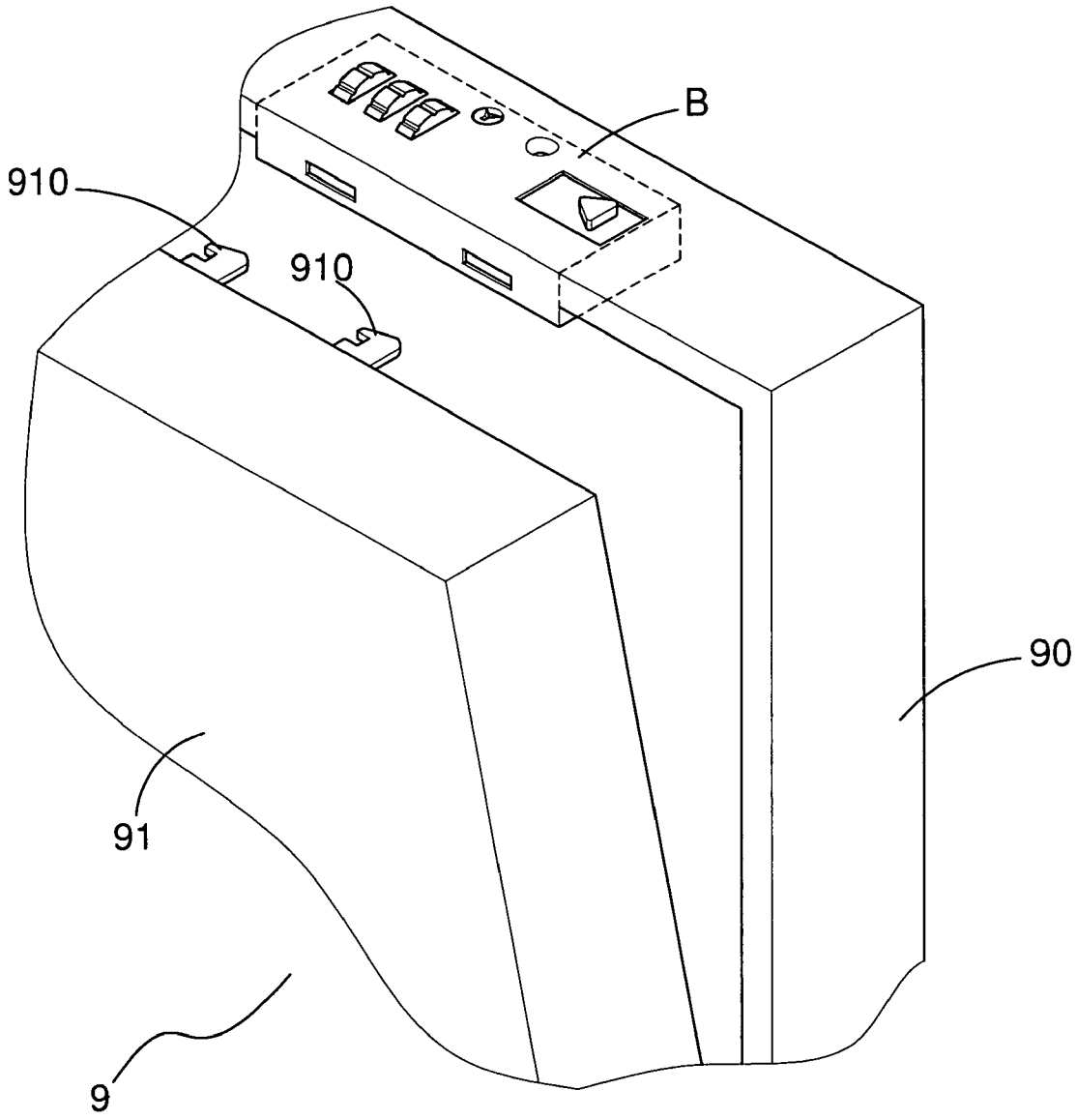
FIG. 28 is a perspective view of a case in accordance with another aspect of the present invention.

Additionally, as shown in FIG. 28, the dual locking device of the present invention can be further applied to a case 9 which comprises a case body 90, a case cover 91 and the dual locking device B, which is any dual locking device described above. Furthermore, a side of the case body 90 is jointed with a side of the case cover 91, and the plugging members 910 are mounted on the case cover 91 for being secured in the dual locking device B which is mounted on the case body 90.

Numerous characteristics and advantages of the invention have been set forth in the foregoing description, together with details of the structure and function of the invention, and the novel features thereof are pointed out in appended claims. The disclosure, however, is illustrative only, and changes may be made in detail, especially, in matters of shape, size and arrangement of parts, materials and the combination thereof within the principle of the invention, to the full extent indicated by the broad general meaning of the terms in which the appended claims are expressed.

I claim:

1. A dual locking device comprising:

a housing having at least one opening communicating with the interior of the housing;

a switching mechanism having a button and a securing member, the button partly exposed outside of the housing and configured to drive the securing member to move relative to the housing between a locked position where the securing member is exposed in the opening of the housing and an unlocked position where the securing member is displaced from the opening of the housing;

a restriction member being capable of moving through a first route between a retaining position and a first releasing position and through a second route between the retaining position and a second releasing position; wherein the restriction member limits movement of the switching mechanism while in the retaining position, and permits the switching mechanism to move to the unlocked position while in the first and the second releasing positions;

a first locking device mounted on the restriction member and provided for controlling movement of the restriction member via the first route; and a second locking device provided for controlling movement of the restriction member via the second route;

wherein the first locking device is a key lock having a rotor driven by a configured key, and the rotor is received and slidable within a cave of the restriction member for driving the restriction member to rotate.

2. The dual locking device of claim 1, wherein the restriction member has a rail formed in the cave of the restriction member for being ridden by a rider of the rotor.

3. A dual locking device comprising:

a housing having at least one opening communicating with the interior of the housing;

a switching mechanism having a button and a securing member, the button partly exposed outside of the housing and configured to drive the securing member to move relative to the housing between a locked position where the securing member is exposed in the opening of the housing and an unlocked position where the securing member is displaced from the opening of the housing;

a restriction member being capable of moving through a first route between a retaining position and a first releasing position and through a second route between the retaining position and a second releasing position; wherein the restriction member limits movement of the switching mechanism while in the retaining position, and permits the switching mechanism to move to the unlocked position while in the first and the second releasing positions;

a first locking device mounted on the restriction member and provided for controlling movement of the restriction member via the first route;

a second locking device provided for controlling movement of the restriction member via the second route; and an indicator having an identification member directly driven by the restriction member when the dual locking device is unlocked by the first locking device;

wherein the securing member of the switching mechanism includes two retainers overlapped with each other, and the indicator overlies the two retainers of the securing member of the switching mechanism.

4. A dual locking device comprising:

a housing having at least one opening communicating with the interior of the housing;

a switching mechanism having a button and a securing member, the button partly exposed outside of the housing and configured to drive the securing member to move relative to the housing between a locked position where the securing member is exposed in the opening of the housing and an unlocked position where the securing member is displaced from the opening of the housing;

a restriction member being capable of moving through a first route between a retaining position and a first releasing position, and a second route between the retaining position and a second releasing position;

a key lock disposed in the housing and including a rotor capable of being driven by a key so as to rotate the restriction member to the first releasing position via the first route, and thereby the securing member is allowed to move to the unlocked position; and a combination lock disposed in the housing and configured to permit the restriction member moving to the second releasing position so as to allow the securing member moving to the unlocked position when the combination lock is entered a code.

5. The dual locking device of claim 4 further comprising an indicator which is disposed in the housing and movable to an indication position when the dual locking device is unlocked by the key lock.

6. The dual locking device of claim 4, wherein the restriction member is placed in between the securing member and the combination lock; when the key lock is operated, the restriction member moves apart from the securing member to allow the movement of the securing member; and when the combination lock is entered a code, the restriction member remains abutting the securing member and is allowed to be moved by the securing member in a direction toward the combination lock.

7. The dual locking device of claim 4, wherein the securing member of the switching mechanism includes two retainers which simultaneously move into or out of the at least one opening of the housing responsive to operation of the button.

8. The dual locking device of claim 7 further comprising an indicator which overlies the two retainers and is movable to an indication position when the dual locking device is unlocked by the key lock.

* * * * *